US009440122B2

(12) United States Patent
Boyd et al.

(10) Patent No.: US 9,440,122 B2
(45) Date of Patent: Sep. 13, 2016

(54) GOLF CLUBS AND GOLF CLUB HEAD STRUCTURES HAVING CONTOURED BACKSTOP

(71) Applicant: NIKE, Inc., Beaverton, OR (US)

(72) Inventors: Robert Boyd, Flower Mound, TX (US); Mark J. Perry, Hilliard, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/905,184

(22) Filed: May 30, 2013

(65) Prior Publication Data

US 2013/0331202 A1 Dec. 12, 2013

Related U.S. Application Data

(60) Provisional application No. 61/653,826, filed on May 31, 2012.

(51) Int. Cl.
*A63B 53/04* (2015.01)

(52) U.S. Cl.
CPC ..... *A63B 53/0466* (2013.01); *A63B 53/0475* (2013.01); *A63B 53/047* (2013.01); *A63B 2053/0408* (2013.01)

(58) Field of Classification Search
CPC ..... A63B 53/0466; A63B 53/04
USPC ..... 473/329, 345
See application file for complete search history.

(56) References Cited

U.S. PATENT DOCUMENTS

| | | | | |
|---|---|---|---|---|
| 5,499,814 | A * | 3/1996 | Lu | A63B 53/04 473/329 |
| 6,165,081 | A | 12/2000 | Chou | |
| 7,056,228 | B2 * | 6/2006 | Beach et al. | 473/345 |
| 8,226,500 | B2 * | 7/2012 | Yamamoto | A63B 53/0466 473/332 |
| 2005/0075192 | A1 * | 4/2005 | Han | 473/346 |

* cited by examiner

*Primary Examiner* — Michael Dennis
(74) *Attorney, Agent, or Firm* — Banner & Witcoff, Ltd.

(57) ABSTRACT

Golf club and golf club head structures include an inner wall or backstop arranged behind a ball striking surface of the golf club head and defining a gap between the inner wall and a rear surface of the ball striking surface. In some arrangements, the size of the gap may vary along a heel-to-toe length of the inner wall or backstop. For instance, the size of the gap may gradually increase from a first end of the inner wall toward a central region of the inner wall, and may gradually decrease from the central region toward a second end of the inner wall. In some examples, the inner wall or backstop may be connected to the golf club head, for instance, at a first end and/or a second end.

27 Claims, 9 Drawing Sheets

GOLF CLUBS AND GOLF CLUB HEAD STRUCTURES HAVING CONTOURED BACKSTOP

RELATED APPLICATION

The present application claims the benefit of U.S. Patent Application No. 61/653,826 filed on May 31, 2012, and entitled "Golf Clubs and Golf Club Head Structures Having Contoured Backstop," which application is incorporated by reference in its entirety herein.

FIELD OF THE INVENTION

The present invention relates generally to golf clubs and golf club heads. Particular example aspects of this invention relate to a golf club head having a contoured backstop arranged behind a ball striking surface of the golf club head.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Because golf clubs typically are designed to contact the ball at or around the center of the face, off-center hits may result in less energy being transferred to the ball, thereby decreasing the distance of the shot. The energy or velocity transferred to the ball by a golf club also may be related, at least in part, to the flexibility of the club face at the point of contact, and can be expressed using a measurement called coefficient of restitution ("COR"). The maximum COR for golf club heads is currently limited by the United States Golf Association ("USGA") at 0.83. Accordingly, it would be advantageous to provide a golf club head having a flexible ball striking surface that provides an improved or maximized COR.

SUMMARY OF THE INVENTION

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

Aspects of this invention relate to golf club and golf club head structures having a thin walled ball striking surface and a backstop arranged behind the ball striking surface on an interior of the golf club head. In some examples, the backstop may be contoured to provide a greater distance between the ball striking surface and the backstop in a central region of the backstop and ball striking surface than in an end region of the backstop and ball striking surface. This increased distance near a central region allows for additional flexing of the ball striking surface in the central region than nearer the end regions, while reducing and/or preventing overflexing of the ball striking surface. For instance, the backstop may act as a physical barrier to prevent or reduce the flex of the ball striking surface as a golf ball is struck.

BRIEF DESCRIPTION OF THE DRAWINGS

The present invention is illustrated by way of example and not limited in the accompanying figures, in which like reference numerals indicate similar elements throughout, and in which:

FIG. 4A illustrates the golf club head in an at-rest position, while FIG. 4B illustrates the golf club head in an in-use arrangement, for instance, as a golf ball is struck by the ball striking surface of the golf ball head according to at least some examples of this invention.

Figure 1A:
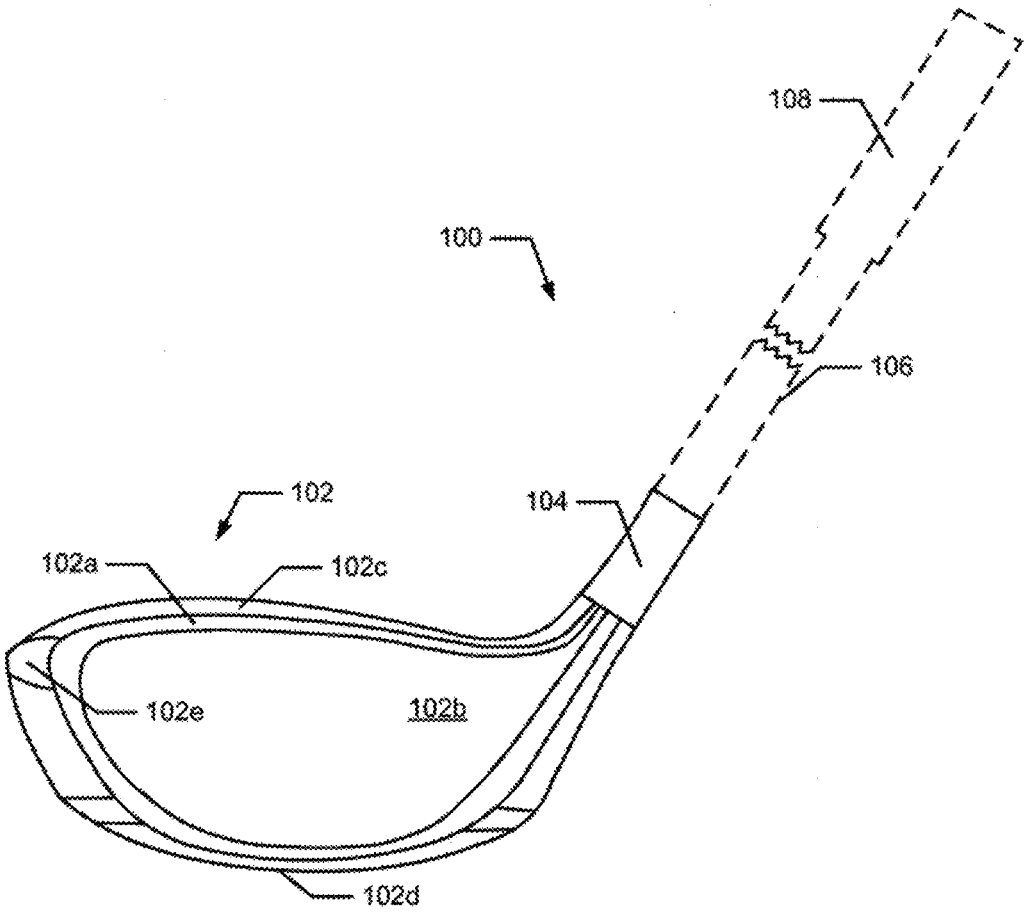
FIGS. 1A and 1B generally illustrate features of golf club and golf club head structures according to at least some examples of this invention.

The reader is advised that the various parts shown in these drawings are not necessarily drawn to scale.

DETAILED DESCRIPTION

The following description and the accompanying figures disclose features of golf clubs and golf club head structures in accordance with examples of the present invention.

I. General Description of Example Golf Clubs and Golf Club Heads in Accordance with this Invention Aspects of this invention relate to golf club and golf club head structures. In some examples, a golf club head may include a golf club head body having at least a top, a bottom, a toe, a heel, a rear and a ball striking surface, the top, bottom, toe, heel, rear and ball striking surface defining an interior portion of the golf club head. The golf club head may further include an inner wall arranged within the interior portion of the golf club head and extending from the toe of the golf club head to the heel of the golf club head. In at least some arrangements, the inner wall is positioned behind the ball striking surface to form a gap between the ball striking surface and the inner wall. In some examples, the inner wall may include a central region, a first side region extending from the central region toward the toe of the golf club head body and a second side region extending from the central region toward the heel of the golf club head body. In at least some arrangements, the gap formed between the inner wall and the ball striking surface may be greater in the central region than in the first side region and the second side region. Further, the inner wall may be configured to act as a backstop for the ball striking surface of the golf club head under at least some conditions as the ball striking surface flexes when the golf club head strikes a golf ball (e.g., when the ball is hit within a certain area of the ball striking surface, when the ball is hit above a predetermined club head speed, etc.).

Additional aspects of the invention relate to the inner wall or backstop being configured to physically contact at least a portion of the ball striking surface as the ball striking surface flexes inward. In at least some examples, the inner wall may be non-linear.

Still other aspects of the invention relate to a golf club having a shaft and a golf club head connected to one end of the shaft. The golf club may include a golf club head having an inner wall arranged within the interior void formed by the golf club head body and positioned behind the ball striking surface. In at least some arrangements, the inner wall extends from the toe to the heel of the golf club head and, in some examples the inner wall may be connected to the golf club head at the toe and/or the heel. In some arrangements, a size of the gap formed between the inner wall and the ball striking surface may vary along a length of the inner wall.

Given the general description of various example aspects of the invention provided above, more detailed descriptions of various specific examples of golf clubs and golf club head structures according to the invention are provided below.

II. Detailed Description of Example Golf Clubs and Golf Club Heads According to the Invention The following discussion and accompanying figures describe various example golf clubs and golf club head structures in accordance with the present invention. When the same reference number appears in more than one drawing, that reference number is used consistently in this specification and the drawings to refer to the same or similar parts throughout.

Various golf club heads in accordance with aspects described herein may be used with various types of golf clubs. For instance, the contoured inner wall or backstop may be used with wood-type golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The contoured inner wall or backstop may also be used with iron-type, hybrid-type, utility type, etc. golf clubs and golf club head structures.

Golf club heads may generally include a plurality of different regions, segments, portions, ends, etc. In an example embodiment, a golf club head may generally include a front face, a rear, a toe, a heel, a crown and a sole that may, generally, define an interior of the golf club head. The golf club heads may include a multiple piece construction and structure, e.g., including one or more of a sole, a front face (optionally including a ball striking surface that may be integrally formed therein or attached thereto), a top or crown, a bottom or sole, a rear, etc. Of course, if desired, various portions of the club head structure may be integrally formed with one another, as a unitary, one piece construction, without departing from the invention (e.g., the front face and/or rear may be integrally formed with the sole and/or crown, etc.). Optionally, if desired, the various portions of the club head structure (such as the sole, the crown, the face, the rear, etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a front face may be attached to a one piece club head aft body (optionally, a hollow body, etc.). More specific examples and features of golf club heads and golf club structures according to this invention will be described in detail below in conjunction with the example golf club structures illustrated in FIGS. 1 through 5F.

Figure 1B:
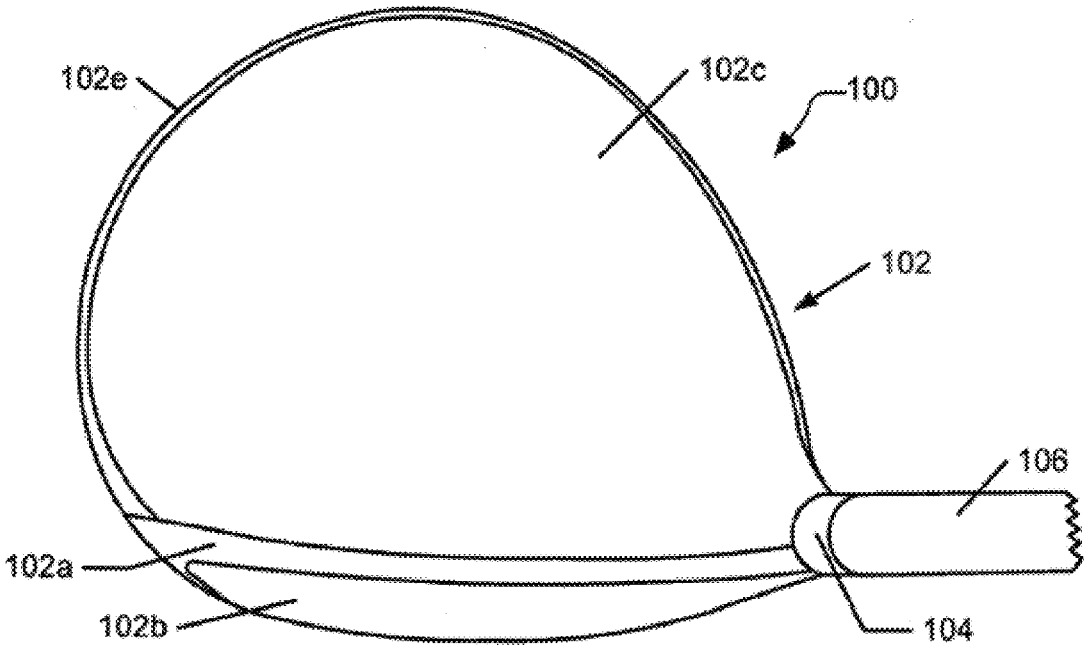

FIGS. 1A and 1B generally illustrate an example wood-type golf club 100 and/or golf club head 102 in accordance with this invention. As mentioned above, aspects of the contoured inner wall or backstop described herein may be used with various other types of golf clubs and golf club head structures, including hybrid type clubs, iron-type clubs, and the like. Although the general description of golf club structures found in FIGS. 1A and 1B is generally directed to wood-type golf club heads, nothing in the disclosure should be viewed as limiting use of the contoured inner wall or backstop as described herein to use with only wood-type golf clubs. Instead, the golf club, golf club heads, etc. described herein may be used with various types of golf clubs without departing from the invention.

In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel (e.g., provided within an interior chamber defined by the club head 102), etc.). The shaft 106 may be received in, engaged with, and/or attached to the golf club head in any desired manner, including in various adjustable manners which permit movement of the shaft 106 with respect to the golf club head 102. Any attachment method and/or structure as are known and used in the art also may be used without departing from this invention.

The shaft 106 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

The club head 102 itself also may be any of various types of golf club heads and may be constructed in any suitable or desired manner and/or from any suitable or desired materials without departing from this invention, including from conventional materials and/or in conventional manners known and used in the art. For example, in the example structure 102 shown in FIGS. 1A and 1B, the club head 102 includes a ball striking surface 102*a* (optionally including a ball striking face plate 102*b* integrally formed with the face 102*a* or attached to the club 100 such that the face plate 102*b* and a frame together constitute the overall ball striking surface 102*a*). The club head 102 of this illustrated example further includes a crown 102*c*, a sole 102*d*, and at least one body portion 102*e* located between the crown or top portion 102*c* and the sole 102*d* (e.g., material extending from the face 102*a*, around the club head periphery from the heel to the toe). This body portion 102*e*, which extends to a location substantially opposite the striking surface 102*a*, may include a rear portion of the club head structure. A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown 102*c*, sole 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the weight of the club head 102, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber reinforced composite materials, polymer materials, etc. The composite or other non-metal material(s) may be incorporated as part of the club head structure 102 in any desired manner, including in conventional manners that are known and used in the art.

The various individual parts that make up a club head structure 102, if made from multiple pieces, may be engaged with one another and/or held together in any suitable or desired manner, including in conventional manners known and used in the art. For example, the various parts of the club head structure 102, such as the ball striking surface 102*a*, the ball striking plate 102*b*, the crown 102*c*, the sole 102*d*, and/or the body portion(s) 102*e* may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

In some arrangements, it may be advantageous for a golf club head, such as golf club head 102, to include an internal wall or backstop. The backstop may allow the front ball striking surface to be made of a thin or relatively thinner material than club heads without a backstop and thus may allow for more flexibility in the front ball striking surface. In addition, the backstop may aid in preventing over flexing of the front wall or ball striking surface, which may result in failure of the front wall (e.g., breaking, cracking, etc.). This added flexibility may provide an improved "spring effect" or coefficient of restitution (COR).

For instance, the improved flexibility of the front ball striking surface may aid in providing a higher COR response for individuals with lower swing speeds. For example, for an individual with an 85 mph swing speed, the front ball striking surface may not contact the backstop, thus allowing the front ball striking surface to provide the maximum possible COR at that swing speed (either within the USGA COR limit of 0.83 or even above this limit, if desired). For individuals with higher or faster swing speeds, the backstop may be positioned to not only reduce or prevent over flexing of the front ball striking surface, but also to limit the COR response of the club head to be 0.83 or less in order to meet the USGA limit. Thus, a club head having an inner wall or backstop may provide a better COR response at lower swing speeds while limiting the COR response for individuals with higher swing speeds to meet regulations.

Figure 2:
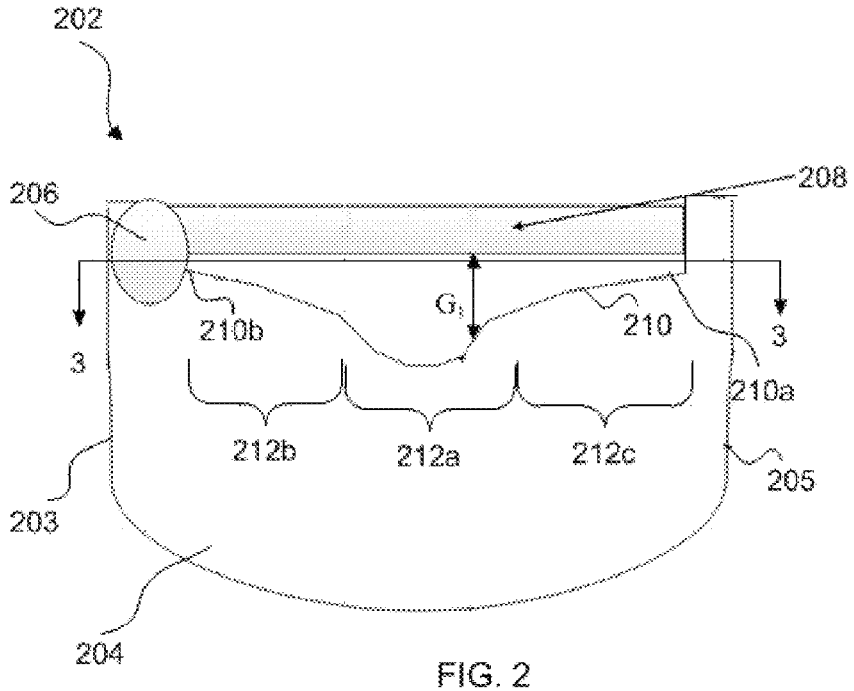
FIGS. 2 and 2A illustrates example golf club heads having a contoured inner wall or backstop according to at least some examples of this invention.

FIG. 2 illustrates one example inner wall or backstop that may be used to provide the above-described advantages. The golf club head 202 includes a rear 204, a hosel 206, a front face plate or ball striking surface 208, and an internal wall or backstop 210. In some examples, the ball striking surface 208 may be a separate portion connected to the golf club head 202 such as by fitting into a channel in the golf club head, a friction fit between walls of the golf club head 202, a mechanical fastener, and the like. Although the wall 210 is shown as a singled piece member, the wall 210 may be formed of two or more portions and may be connected using known means of connection, without departing from the invention.

As shown in FIG. 2, the internal wall or backstop 210 may be contoured, as will be discussed more fully below. The internal wall or backstop 210 may be formed of a lightweight material, such as a lightweight metal. Some example lightweight metals that may be used include steel, titanium and titanium alloys, aluminum and aluminum alloys, magnesium and magnesium alloys, etc. Additionally or alternatively, the inner wall or backstop 210 may be formed of any of these metal materials and/or from composite materials, such as carbon fiber composite materials, fiberglass composite materials, basalt fiber composite materials, polymer materials, etc. In still other arrangements, the backstop 210 may be formed having a matrix structure, rather than as a solid wall, in order to further reduce weight associated with the backstop 210.

In some examples, the backstop 210 may be fixed to the golf club head 202 at one or more ends 210*a*, 210*b*, such as with mechanical fasteners, screws, adhesives, and the like. In some examples, the ends 210*a*, 210*b* of the backstop 210 may be connected to the golf club head via screws formed of a composite material to reduce weight added to the golf club head 202. The fixed ends 210*a*, 210*b* of the backstop 210 may provide additional stiffness and structure to those points (e.g., points having greater or increased stress during flexing). The portion of the backstop 210 extending between each fixed end 210*a*, 210*b* might not be fixed to the golf club head 202, thereby allowing for at least some flexibility of the backstop 210, in some arrangements. The backstop 210 also may be formed, at least in part, as an integral structure with one or more of the parts of the club head body. For instance, the backstop 210 may be integrally formed with the club head body such that the ends 210*a*, 210*b* of the backstop 210 are integrally formed with the toe and/or heel of the golf club head. This arrangement may provide additional stiffening characteristics for the backstop 210. In some examples, the ball striking face may be connected to the golf club head body, integrally formed backstop, etc.

As shown in FIG. 2, the backstop 210 extends generally from a heel 203 of the golf club head 202 to the toe 205 and is positioned generally behind the front ball striking surface 208. That is, in this example structure 200, the backstop 210 is positioned within an interior void of the golf club head formed by the top, bottom, toe, heel, etc. of the golf club head 200, and may be positioned more toward a center of the golf club head 200 than the ball striking surface 208. The backstop 210 may be arranged behind the ball striking surface 208 such that a space or gap $G_1$ exists between the ball striking surface 208 and the backstop 210 when the club head 202 is at rest (i.e., when a ball is not being struck by the ball striking surface 208). This gap $G_1$ may allow for flex in the ball striking surface 208, or at least portions thereof, when a golf ball is struck by the ball striking surface 208 of the golf club head. As shown in FIG. 2, a size of the gap $G_1$ may vary along a length of the inner wall or backstop 210 in the heel 203 to toe 205 direction. For instance, the size of the gap $G_1$ may extend from 0.1 inches to 0.75 inches. This gap $G_1$ and flexibility of the ball striking surface 208 will be discussed more fully below.

As mentioned above, the backstop 210 may have a contoured shape. For instance, the backstop 210 may be non-linear to allow for additional flexing of the ball striking surface 208 in some portions and to limit the amount of flexing of the ball striking surface 208 in other portions. For instance, the golf club head 202 may have an inner wall or backstop 210 having three regions, a central region 212*a* and two side regions, 212*b*, and 212*c*. The central portion of the region 212*a* may be arranged a greater distance from the ball striking surface 208 than at least one of end regions 212*b*, 212*c* of the backstop 210. The arrangement of FIG. 2 illustrates an inner wall or backstop 210 having a gradual or relatively shallow slope in the end regions 212*b*, 212*c*. This gradual slope may allow for the size of the gap $G_1$ to gradually increase as the inner wall or backstop 210 extends from an end portion 210*a*, 210*b* toward the central region 212*a*. The central region 212*a* of the backstop 210 may have a steeper or more substantial slope to increase the size of the gap $G_1$ in the central region. In some examples, the maximum gap $G_1$ size along the length of the inner wall or backstop 210 will be positioned in the central region 212*a*. This increased distance between the backstop 210 and the ball striking surface 208 in the central region 212*a* may allow for greater flexibility of a corresponding central portion of the ball striking surface 208. Various other geometries (both linear and non-linear geometries) may be used without departing from the invention, as will be discussed more fully below.

In some instances, computer modeling applications may be used to determine an optimal geometry of the backstop 210. For instance, computer modeling may be used to determine a desired or optimal shape to provide an appropriate COR response, etc., e.g., based on an individual's typical or dominant ball contact location on the ball striking face 208 surface. In some arrangements, the backstop 210 shape or geometry may be customized to a particular player, swing, swing speed, etc. using computer modeling.

Figure 2A:
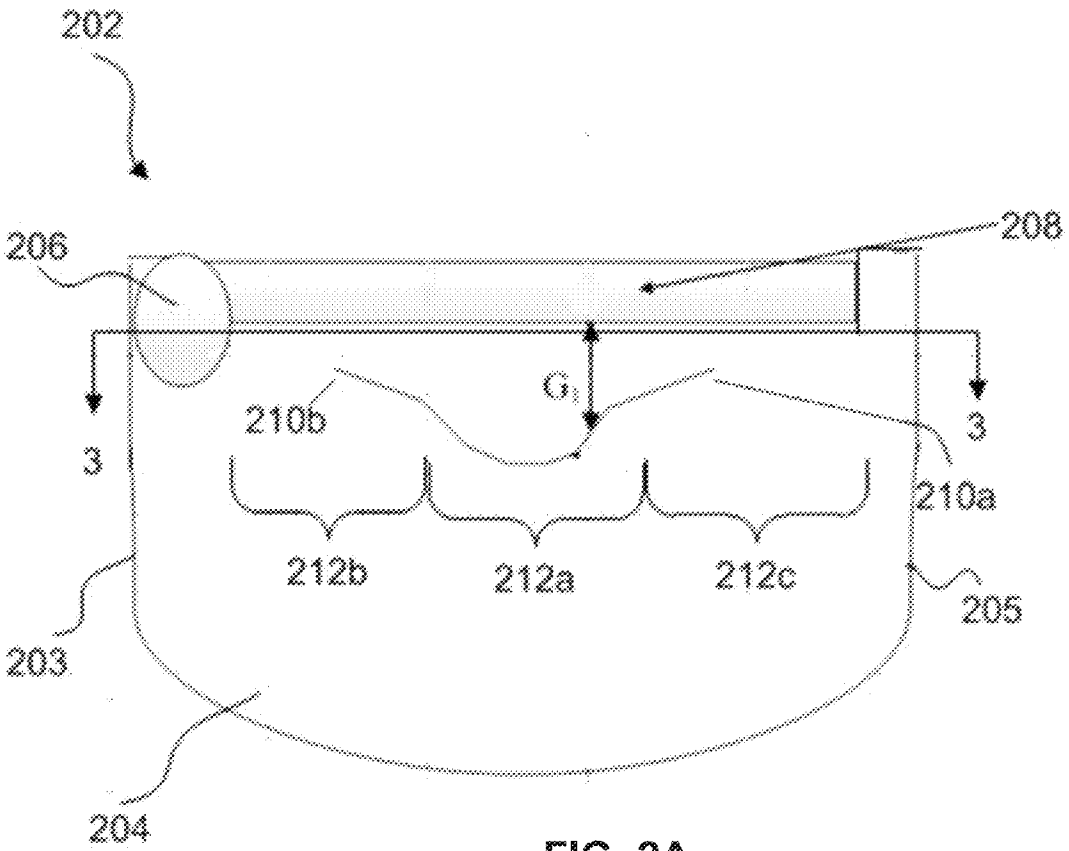

One or more end portions 210*a*, 210*b* of the inner wall or backstop 210 may be connected to the golf club head 202 (e.g., a sidewall of the golf club head 202 or other internal connection point) and the side regions 212*b*, 212*c* may slope away from the ball striking surface 208, such that the distance between the ball striking surface 208 and each side region 212*b*, 212*c* increases as the backstop 210 extends from the end point toward the central region 212*a*. Although the backstop 210 of FIG. 2 is shown as extending substantially the entire distance between the toe 205 and heel 203 of the golf club head 202, the use of internal support to act as connect points for the backstop 210 may allow the backstop 210 to span a shorter distance, as desired. For instance, the backstop 210, as shown in FIG. 2A, may extend along a distance substantially equal to 40-80% of the length of the ball striking surface 208 and may positioned behind the ball striking surface 208 in a central region of the ball striking surface 208 to allow increased flexibility in the center of the ball striking surface 208.

Figure 3:
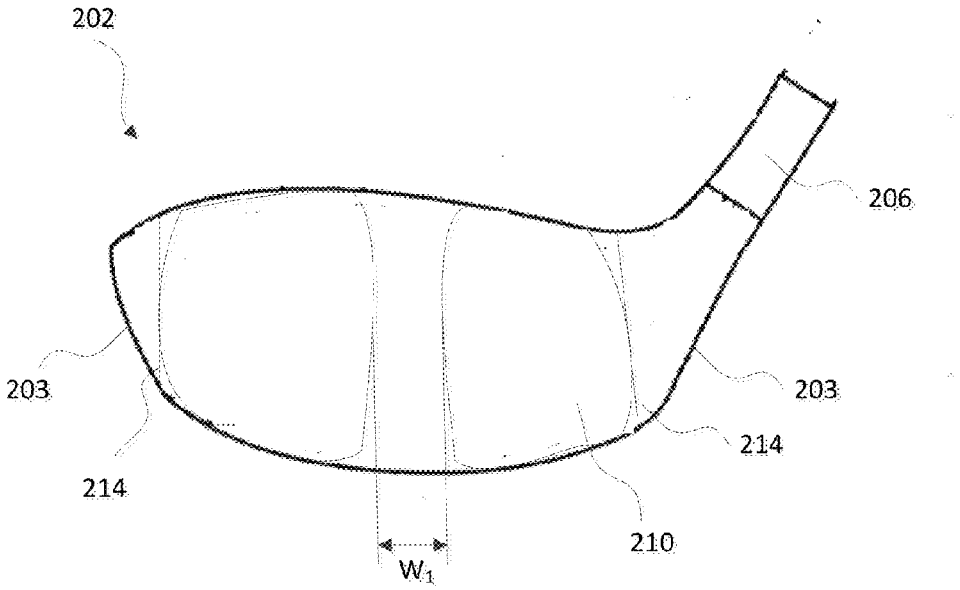
FIG. 3 is a cross sectional view of the golf club head of FIG. 2 further illustrating the contoured inner wall or backstop according to at least some examples of this invention.

FIG. 3 is a cross sectional view of the golf club head 202 of FIG. 2 taken along line 3-3. The hosel 206 and backstop 210 are shown from a front view. The golf club head 202 may include internal supports 214 arranged near a toe 205 and a heel 203 of the golf club head 202. The internal supports 214 may provide a structure to which the ends 210*a*, 210*b* of the backstop 210 may be connected to the golf club head 202. For instance, the ends 210*a*, 210*b* of the backstop 210 may be connected to the internal supports 214, such as via threaded fasteners or other mechanical fasteners, welds, adhesives, and the like. As discussed above, connecting the ends 210*a*, 210*b* of the backstop 210 to the golf club head 202 may provide increased stiffness at the ends to aid in maintaining the position of the backstop 210 when contacted by the front ball striking surface 208 when a golf ball is struck. The width of the central region $W_1$ is illustrated as relatively constant along the height of the backstop 210. However, in some examples, the width $W_1$ of the central region may vary along the height of the backstop 210. In some examples, this width $W_1$ may be between 0.2 and 1.2 inches wide.

Although FIG. 3 shows the backstop 210 as connected to the golf club head 202 via internal supports 214, the backstop 210 may be connected directly to and/or integrally formed as part of the golf club head 202, such as at the toe 205 and heel 203 of the golf club head 202, without any intervening support structure.

Figure 4A:
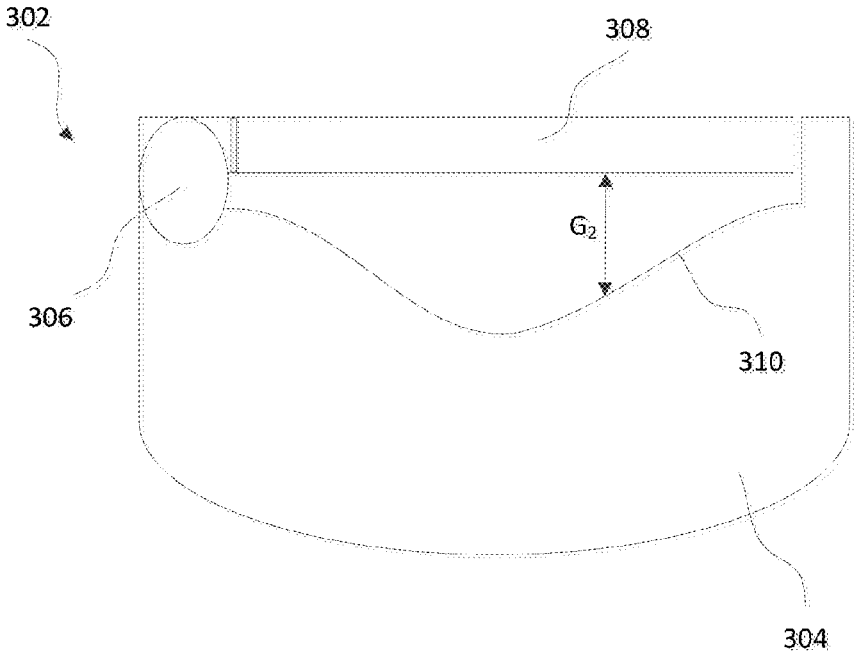
FIGS. 4A and 4B illustrate another example golf club head having a contoured inner wall or backstop.
Figure 4B:
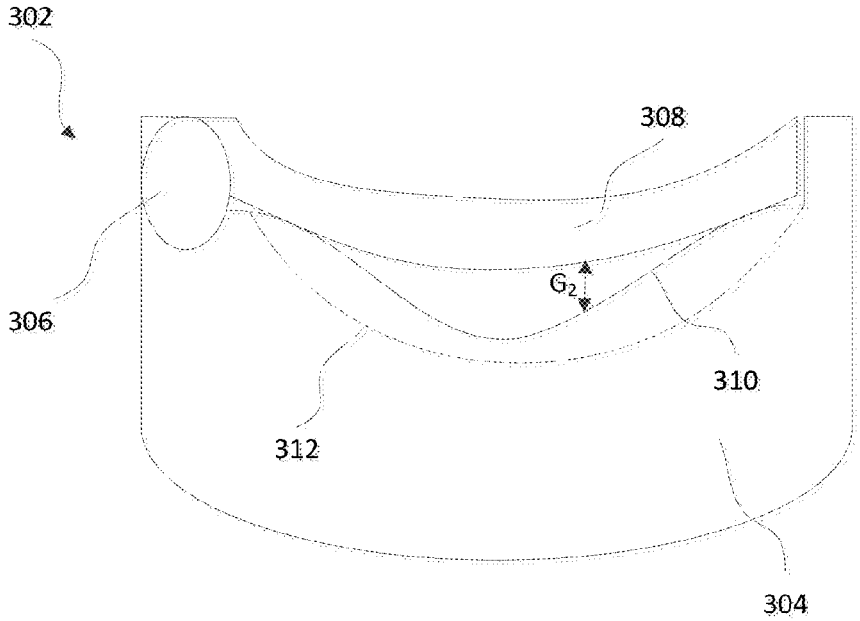

FIGS. 4A and 4B illustrate one example arrangement of a contoured inner wall or backstop and flexible ball striking surface. The golf club head 302 includes a rear 304, a hosel 306, a ball striking surface 308 and an inner wall or backstop 310. Similar to the arrangement of FIG. 2, a gap $G_2$ is present between the ball striking surface 308 and the backstop 310. Also similar to the arrangement of FIG. 2, the contour of the backstop 310 provides for a gradual increase of the gap $G_2$ as the backstop extends from an end point, that may be connected to the golf club head 302, toward a central portion of the backstop 310. FIG. 4A illustrates the golf club head 302 in an at rest position. Accordingly, the ball striking surface 308 is generally planar.

FIG. 4B illustrates the example golf club head 302 as it strikes a golf ball (not shown). As the golf club head 302 strikes the golf ball, the ball striking surface 308 may flex inward, toward the backstop 310, thereby reducing the size of the gap $G_2$. As the ball striking surface 308 flexes inward, portions of the ball striking surface 308 may contact the backstop 310 which may reduce or prevent additional flexing of the ball striking surface 308 or that portion of the ball striking surface 308. For instance, as shown in FIG. 4B, the end regions of the ball striking surface 308 contact the portions of the backstop 310 closer to the ball striking surface 308. Accordingly, the backstop may reduce or prevent additional flexing in those areas. However, the contour of the backstop 310 may allow additional flexing in the central portion of the ball striking surface 308, due to the greater distance between the ball striking surface 308 and the backstop 310 (i.e., greater gap distance $G_2$) in the central region or portion.

Line 312 represents the potential flex of the ball striking surface 308 without the presence of the backstop 310. Without the backstop 310, the ball striking surface 308 may flex more than it would with the backstop 310 present, which may result in greater stress on the material of the ball striking surface 308 and thus increased likelihood of cracking, fatigue, failure, etc. This arrangement including the backstop 310 may maintain the COR response of the club head within USGA limits, and may prevent overflexing of the ball striking surface 308 which may result in damage, such as cracking, breaking, and the like.

In some examples, the backstop 310 may have some flexibility or give in the area located between the end points connected to the golf club head 302. This flexibility or give may permit the backstop 310 to somewhat flex when contact is made between the ball striking surface 308 and the backstop 310 to provide additional springiness, without permitting overflexing of the ball striking surface 308.

Figure 5A:
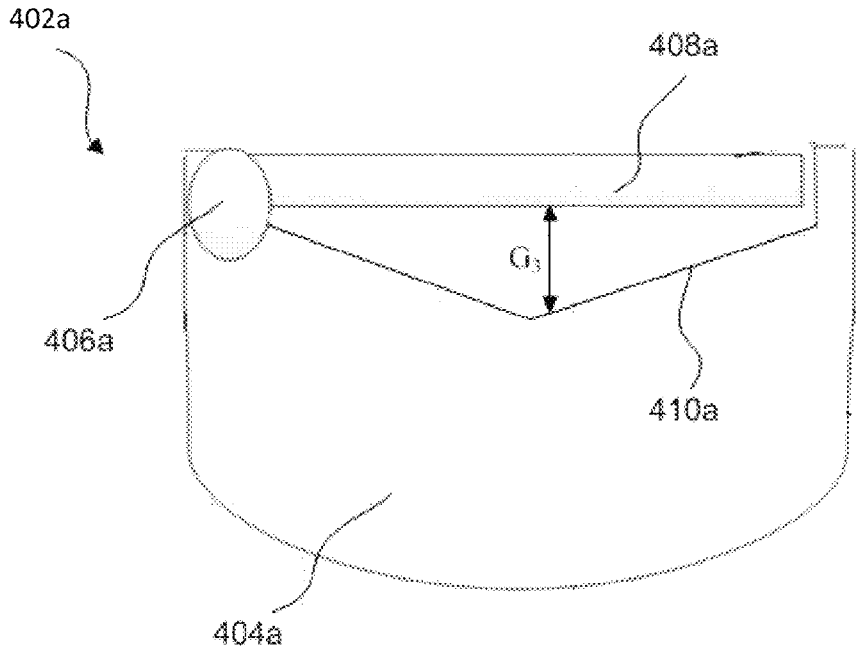
FIGS. 5A-5F illustrate example golf club heads having various alternative inner wall or backstop arrangements according to at least some examples of this invention.

FIGS. 5A-5F illustrate various alternate arrangements of an inner wall or backstop according to aspects described herein. FIG. 5A illustrates one example golf club head 402*a* having a rear 404*a*, a hosel 406*a*, a ball striking surface 408*a* and a backstop 410*a* having a V-shaped configuration. The V-shaped configuration provides a greater gap $G_3$ between the ball striking surface 408*a* and the backstop 410*a* near a central portion of the backstop 410*a* and ball striking surface 408*a*, than between the ball striking surface 408*a* and the end regions of the backstop 410*a*. Accordingly, the backstop 410*a* may act to reduce or prevent flexing of the ball striking surface 408*a* near the end regions of the ball striking surface 408*a* by acting as a barrier to the ball striking surface 408*a*. Further, the backstop 410*a* may permit additional flexing of the ball striking surface 408*a* in a central region of the ball striking surface. However, the backstop 410*a* may reduce or prevent overflexing of the ball striking surface 408*a* in the central portion, as well, by acting as a physical barrier.

Figure 5B:
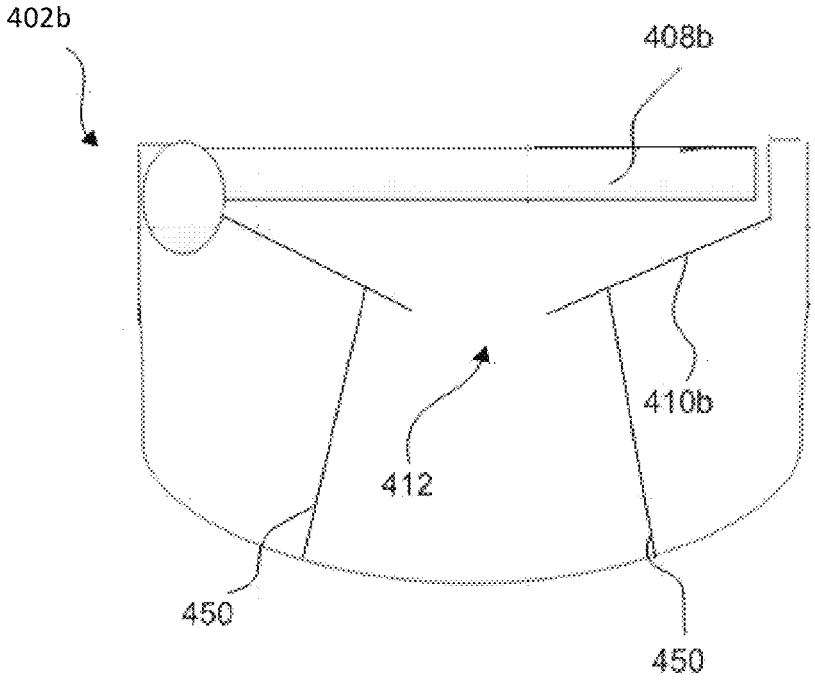

FIG. 5B illustrates another example golf club head 402*b* having a ball striking surface 408*b* and a backstop 410*b*. As shown, similar to the arrangements discussed above, the gap between the ball striking surface 408*b* and the backstop 410*b* may gradually increase as the backstop 410*b* extends from each end toward a central region of the backstop 410*b*. The backstop 410*b* may further include an aperture 412 arranged in the central region of the backstop 410*b*. This aperture may further allow additional flexing of the ball striking surface 408*b* in the central region, while acting as a barrier to prevent or reduce overflexing of the ball striking surface 408*b*. In some examples, the aperture 412 may extend entirely through the backstop 410*b*, as shown in FIG. 5B. Additionally or alternatively, the backstop 410*b* may be formed of two separate pieces that may leave a gap between them (e.g., forming gap 412). In one or more examples, the free edge may be supported by a support 450 that may extend to the rear of the golf club head or may extend toward a toe or heel of the golf club head. In still other examples, the support 450 may extend toward a top or bottom of the golf club head. The support 450 may be connected to the golf club head using known methods of connection.

Figure 5C:
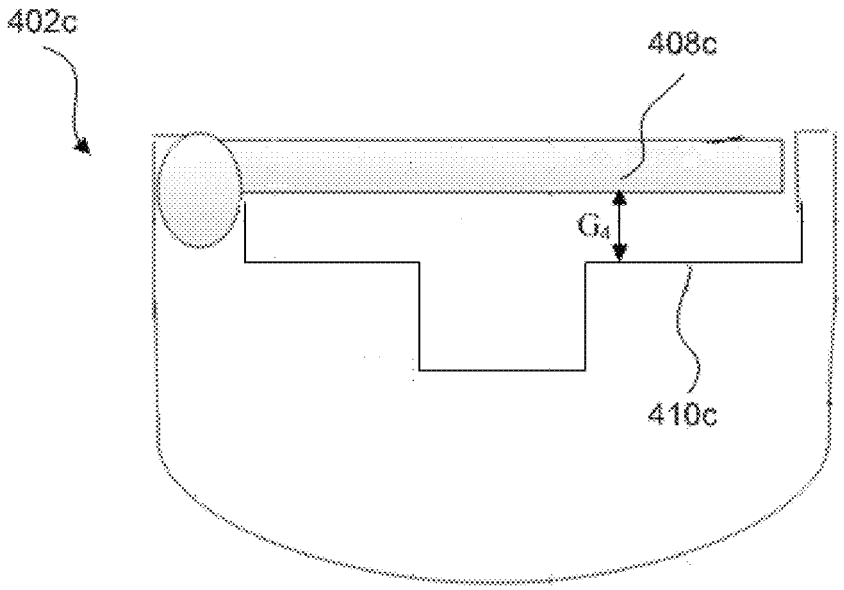
Figure 5D:
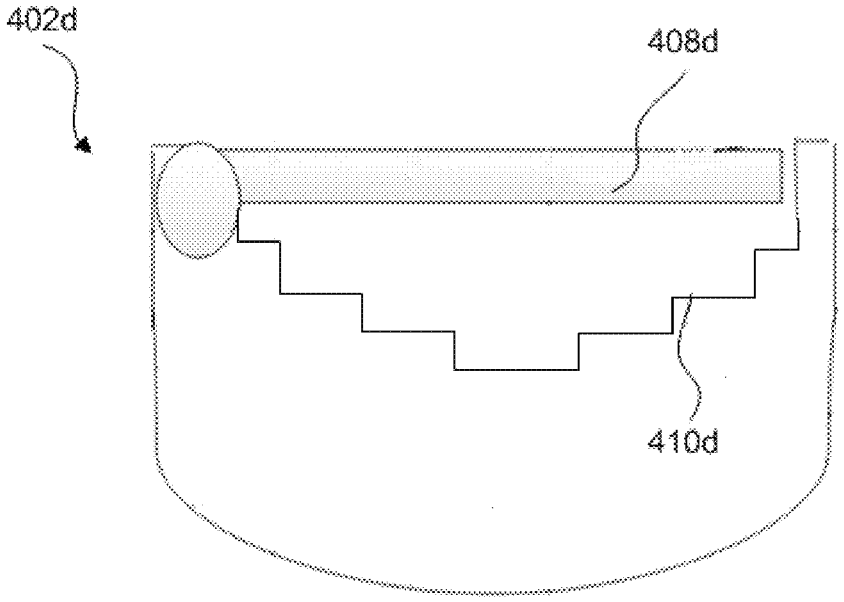

FIG. 5C illustrates yet another example golf club head 402*c* having a backstop arrangement. The golf club head 402*c* includes a ball striking surface 408*c* and a backstop 410*c*. The backstop 410*c* has a step-down type arrangement which provides an increasing gap $G_4$ between the ball striking surface 408*c* and the backstop 410*c* as the backstop 410*c* extends from its end regions toward a central region of the backstop 410*c*. FIG. 5D illustrates another backstop 410*d* having a step-down arrangement which, more gradually than backstop 410*c*, increases the distance between the ball striking surface 408*d* and the backstop 410*d* as the backstop 410*d* extends from its end regions toward a central region.

Figure 5E:
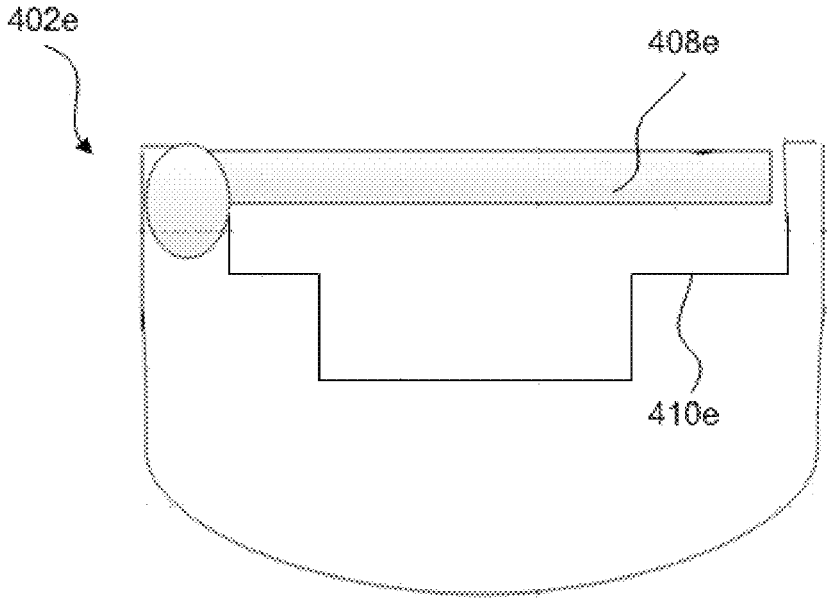
Figure 5F:
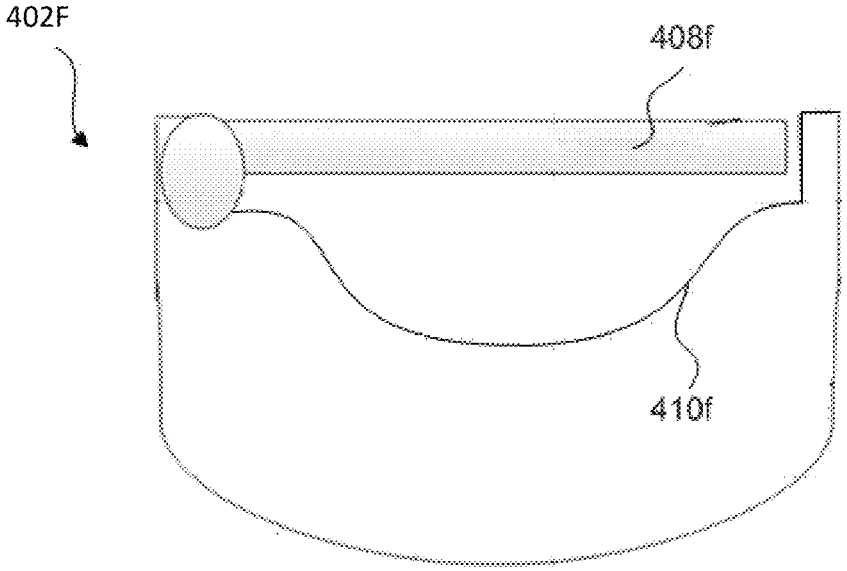

As mentioned above, the width of the central region of the backstop may vary. FIGS. 5E and 5F illustrate backstop arrangements having a central region that is generally wider than some of the arrangements discussed above. In FIG. 5E, the backstop 410*e* has a step-down arrangement similar to the arrangement of FIG. 5C. However, the central portion in which the size of the gap between the ball striking surface 408*e* and the backstop 410*e* is the greatest is substantially wider than the arrangement of FIG. 5C. This may allow for a wider portion of the ball striking surface 408*e* to flex, while still providing a physical barrier to reduce or prevent overflexing of the ball striking surface 408*a*.

FIG. 5F provides another arrangement in which the central portion of the inner wall or backstop 410*f* is wider than some other arrangements discussed above. The inner wall or backstop 410*f* is non-linear and the size of the gap between the ball striking surface 408*f* and the backstop 410*f* more gradually increases as the backstop 410*f* extends from an end region toward a central region, than, for instance, the arrangement of FIG. 5E.

Figure 6A:
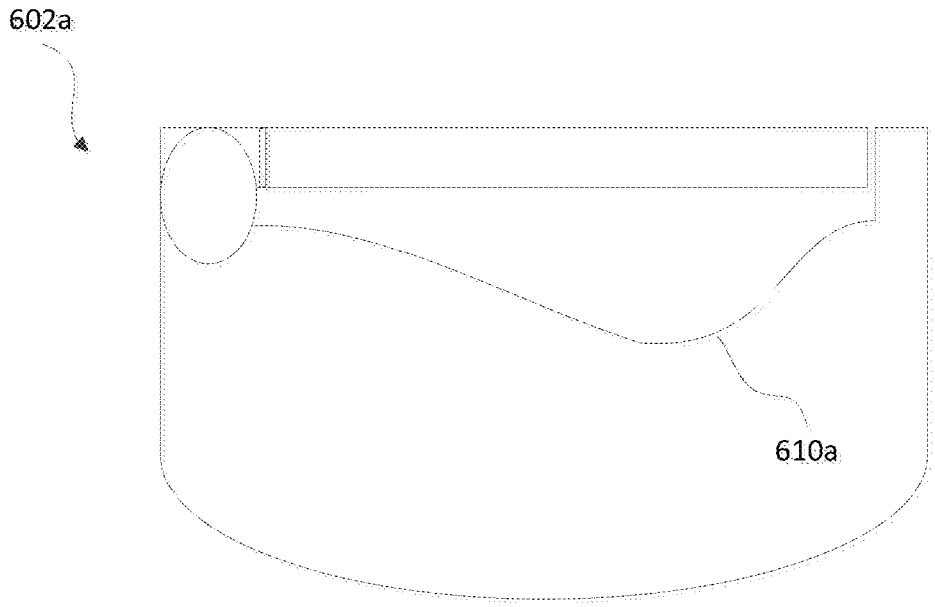
FIGS. 6A and 6B illustrate example golf club heads having alternate backstop arrangements according to one or more aspects described herein.
Figure 6B:
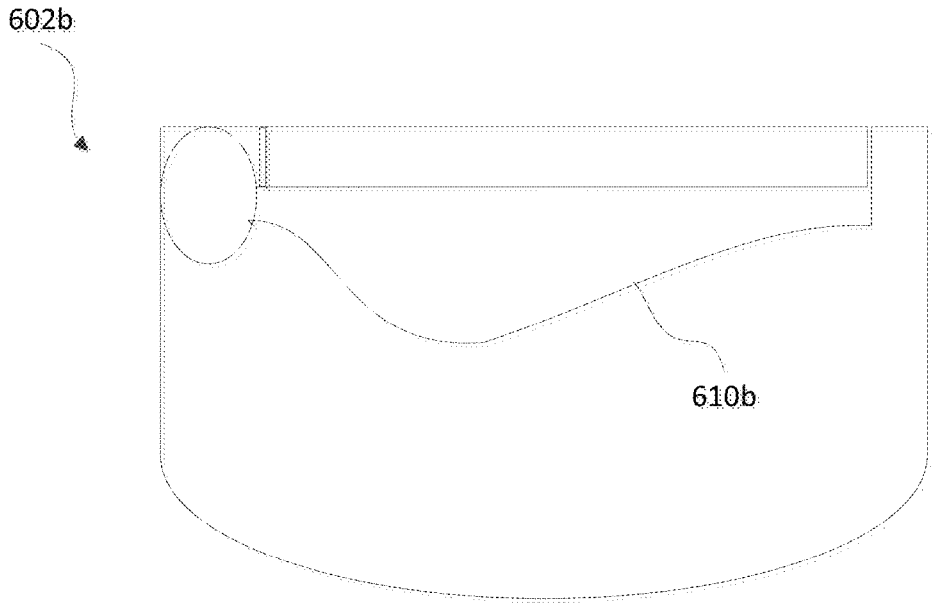

Further, the shape, contour, etc. of the interior wall or backstop of one or more arrangement described herein may be customized for a particular user's swing. For instance, the deepest portion of the wall or backstop may be offset to accommodate a user with a slice, hook, etc. For instance, FIGS. 6A and 6B illustrate alternate backstop arrangements with backstops 610*a* and 610*b* having the deepest portion offset from a center of the backstop.

It is understood that the structures disclosed herein could also be incorporated into other types of golf clubs including iron-type golf clubs as well as fairway woods and hybrids.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 6B may be used individually and/or in any combination or subcombination without departing from this invention.

What is claimed is:

1. A golf club head, comprising:

a golf club head body having a ball striking face and defining an interior portion, the ball striking face having a length; and an inner wall arranged within the interior portion of the golf club head and positioned behind a central region of the ball striking face to form a gap between at least some portions of the ball striking face free of connection to a sidewall on a heel side and a toe side and the inner wall, the inner wall having a central region, a first side region extending from the central region toward a toe of the golf club head body and a second side region extending from the central region toward a heel of the golf club head body, the inner wall having a length, the inner wall has a crown end engaged with an inner surface of a crown, a sole end engaged with an inner surface of a sole, the central region disposed between the crown end and the sole end;

wherein the gap formed between the inner wall and the ball striking face is greater in the central region than in the first side region and the second side region and is in a range from 0.1 inches to 0.75 inches, wherein the inner wall is positioned and configured to act as a backstop for the ball striking face of the golf club head under some conditions as the ball striking face flexes when the golf club head strikes a golf ball;

wherein the length of the inner wall is 40% to 80% of the length of the ball striking face, and wherein the central region tapers such that each of the crown end and the sole end have a length that is greater than a length of the central region.

2. The golf club head of claim 1, wherein the inner wall is contoured.

3. The golf club head of claim 1, wherein the length of the central region is between 0.2 inches and 1.2 inches.

4. The golf club head of claim 1, wherein the inner wall is connected to the golf club head at least a first end point of the inner wall.

5. The golf club head of claim 1, wherein the inner wall has a V-shaped configuration.

6. The golf club head of claim 1, wherein the inner wall includes an aperture formed in the central region of the inner wall and extending through the inner wall.

7. The golf club head of claim 1, wherein at least a portion of a rear side of the ball striking face physically contacts at least a portion of the inner wall when the ball striking face flexes at least a predetermined amount upon contacting the golf ball.

8. The golf club head of claim 1, further including a hosel for engaging a shaft to be connected to the golf club head.

9. The golf club head of claim 1, wherein the golf club head is a wood-type golf club head.

10. A golf club head, comprising:

a golf club head body defining an interior void, the golf club head body further including a ball striking face configured to flex inward, toward the interior void upon contacting a golf ball, the ball striking face having a length; and an inner wall having a length, and arranged within the interior void of the golf club head and positioned behind a central portion of the ball striking face, connected to an inner surface of a crown and an inner surface of a sole over the entire length of the inner wall, and free of connection to a sidewall on a heel side and a toe side, at least a portion of the inner wall being configured to physically contact at least a portion of a rear surface of the ball striking face under some conditions as the ball striking face flexes inward, a contact surface of the inner wall being non-planar, the inner wall has a crown end engaged with an inner surface of a crown, a sole end engaged with an inner surface of a sole, the central region disposed between the crown end and the sole end; and wherein the length of the inner wall is 40% to 80% of the length of the ball striking face; and wherein the central region tapers such that each of the crown end and the sole end have a length that is greater than a length of the central region.

11. The golf club head of claim 10, wherein a gap is formed between the inner wall and the rear surface of the ball striking face.

12. The golf club head of claim 11, wherein a size of the gap between the inner wall and the rear surface of the ball striking face varies as the inner wall extends in a direction from a toe toward a heel of the golf club head.

13. The golf club head of claim 12, wherein the gap is at a maximum size in a central region of the inner wall.

14. The golf club head of claim 10, further including a hosel for engaging a shaft to be connected to the golf club head.

15. The golf club head of claim 14, wherein the golf club is a wood-type golf club.

16. A golf club, comprising:

a shaft;

a golf club head at one end of the shaft, the golf club head including a ball striking face and defining an interior void, the ball striking face having a length; and an inner wall having a length, and arranged within the interior void and positioned behind in a central region of the ball striking face, connected to an inner surface of a crown and an inner surface of a sole over the entire length of the inner wall, and free of connection to a sidewall on a heel side and a toe side, and the inner wall extending in a direction from a toe side toward a heel side of the golf club head, the inner wall has a crown end engaged with an inner surface of the crown, a sole end engaged with an inner surface of a sole, the central region disposed between the crown end and the sole end, wherein a gap is formed between the inner wall and a rear surface of the ball striking face, and wherein a size of the gap varies along a length of the inner wall in the heel side to toe side direction, such that the size of the gap increases as the inner wall extends from an end point toward the central region and is in a range from 0.1 inches to 0.75 inches; and wherein the length of the inner wall is 40% to 80% of the length of the ball striking face; and wherein the central region tapers such that each of the crown end and the sole end have a length that is greater than a length of the central region.

17. The golf club of claim 16, wherein a surface of the inner wall facing the rear surface of the ball striking face is non-planar.

18. The golf club of claim 17, wherein the inner wall includes a first portion having a first slope, a second portion having a second slope greater than the first slope, and a third portion having a more gradual slope than the second slope.

19. The golf club of claim 18, wherein the second portion is arranged between the first portion and the third portion.

20. The golf club of claim 18, wherein the second portion is arranged in a central region of the inner wall.

21. The golf club of claim 16, wherein the inner wall includes an aperture formed in a central region of the inner wall.

22. The golf club of claim 16, further including a first internal support at the heel of the golf club head and a second internal support at the toe of the golf club head.

23. The golf club head of claim 22, wherein the inner wall is connected to the golf club head via at least one of the first internal support and the second internal support.

24. The golf club of claim 16, wherein the golf club is a wood-type golf club.

25. A golf club head, comprising:

a golf club head body having a ball striking face and defining an interior portion, the ball striking face having a length; and an inner wall having a length, and arranged within the interior portion of the golf club head and positioned behind a central region of the ball striking face to form a gap between at least some portions of the ball striking face, connected to an inner surface of a crown and an inner surface of a sole over the entire length of the inner wall, and free of connection to a sidewall on a heel side and a toe side and the inner wall, the inner wall having a central region, a first side region extending from the central region toward a toe of the golf club head body and a second side region extending from the central region toward a heel of the golf club head body, the inner wall has a crown end engaged with an inner surface of a crown, a sole end engaged with an inner surface of the sole, the central region disposed between the crown end and the sole end;

wherein the inner wall is connected to the club head at internal supports near a heel and a toe;

wherein the gap formed between the inner wall and the ball striking face is greater in the central region than in the first side region and the second side region and is in a range from 0.1 inches to 0.75 inches; and wherein the length of the inner wall is 40% to 80% of the length of the ball striking face; and wherein the central region tapers such that each of the crown end and the sole end have a length that is greater than a length of the central region.

26. The golf club head of claim 25, wherein a portion of the inner wall is made of a polymer.

27. The golf club head of claim 25, wherein the internal supports connect to the inner wall with a mechanical fastener.

* * * * *